US011670859B1

(12) United States Patent
Leung et al.

(10) Patent No.: US 11,670,859 B1
(45) Date of Patent: Jun. 6, 2023

(54) TRI-BAND DUAL-POLARIZED OMNIDIRECTIONAL ANTENNA

(71) Applicant: City University of Hong Kong, Kowloon (HK)

(72) Inventors: Kwok Wa Leung, Kowloon Tong (HK); Peng Fei Hu, Kowloon Tong (HK)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 17/705,689

(22) Filed: Mar. 28, 2022

(51) Int. Cl.

| | |
|---|---|
| ***H01Q 5/10*** | (2015.01) |
| ***H01Q 1/22*** | (2006.01) |
| ***H01Q 9/04*** | (2006.01) |
| ***H01Q 5/28*** | (2015.01) |
| ***H01P 7/10*** | (2006.01) |
| ***H01Q 7/00*** | (2006.01) |

(52) U.S. Cl.
CPC ..... *H01Q 9/0485* (2013.01); *H01P 7/10* (2013.01); *H01Q 1/2291* (2013.01); *H01Q 5/10* (2015.01); *H01Q 5/28* (2015.01); *H01Q 7/00* (2013.01)

(58) Field of Classification Search
CPC ..... H01Q 5/28; H01Q 7/00; H01Q 9/0485; H01P 7/10
See application file for complete search history.

(56) References Cited

U.S. PATENT DOCUMENTS

| | | | |
|---|---|---|---|
| 8,368,609 B2 | 2/2013 | Morrow et al. | |
| 8,988,298 B1 | 3/2015 | Akhoondzadehasl et al. | |
| 10,812,749 B2 | 10/2020 | Yang | |
| 2021/0066816 A1* | 3/2021 | Leung | H01Q 1/50 |

FOREIGN PATENT DOCUMENTS

| | | | |
|---|---|---|---|
| CN | 104993239 A | * | 10/2015 |
| KR | 20070102340 A | * | 10/2007 |

OTHER PUBLICATIONS

L. Zou, D. Abbott and C. Furneaux, "Omnidirectional Cylindrical Dielectric Resonator Antenna With Dual Polarization," in IEEE Antennas and Wireless Propagation Letters, vol. 11, pp. 515-518, 2012, doi: 10.1109/LAWP.2012.2199277. (Year: 2012).*

L. Zou, K. Abbott and C. Fumeauz, "Omnidirectional Cylindrical Dielectric Resonator Antenna with Dual Polarization," in IEEE Antennas and Wireless Propagation Letters, vol. 11, pp. 515-518, 2012, doi: 10.1109/LAWP.2012.2199277 (Year: 2012).*

Omnidirectional Dielectric Resonator Antenna With a Planar Feed for Circular Polarization Diversity Design, Weiwei Li, Kwok Wa Leung, Nan Yang, IEEE Transactions on Antennas and Propagation, vol. 66, No. 3, Mar. 2018.

U.S. Appl. No. 17/331,388.

* cited by examiner

*Primary Examiner* — Ab Salam Alkassim, Jr.
*Assistant Examiner* — Leah Rosenberg
(74) *Attorney, Agent, or Firm* — Renner Kenner Greive Bobak Taylor & Weber

(57) ABSTRACT

A tri-band omnidirectional dual-polarized antenna that includes a dielectric resonator, a first substrate containing a first feeding circuit; and a second substrate containing a second feeding circuit. The first substrate and the second substrate are both planar, which form a sandwiching structure with the dielectric resonator. The first and second feeding circuits are adapted to provide dual polarizations to three frequency bands. The antenna can be used in the tri-band wireless communication systems to provide large signal coverage and stable wireless access for mobile terminals.

13 Claims, 3 Drawing Sheets

TRI-BAND DUAL-POLARIZED OMNIDIRECTIONAL ANTENNA

FIELD OF INVENTION

This invention relates to RF antennas, and in particular to omnidirectional RF antennas.

BACKGROUND OF INVENTION

Wi-Fi 6 technology, which supports three bands (2.4, 5.2, and 5.8 GHz), has been widely used in advanced wireless routers. Wireless routers usually use monopole antennas, which only have a single linear polarization. In comparison, dual-polarized omnidirectional antennas are more stable compared to single polarized ones. However, even when a dual-polarized omnidirectional antenna is used in a Wi-Fi 6 router, additional antenna(s) is still required because existing dual-polarized omnidirectional antenna designs cannot cover the three Wi-Fi bands (2.4, 5.2, and 5.8 GHz) by using only one antenna. On the other side, currently it is still a challenge to design omnidirectional dual-polarized antennas in even just two bands and simultaneously maintain a compact size for consumer routers.

SUMMARY OF INVENTION

Therefore, it is an object of the present invention to design a tri-band dual-polarized omnidirectional antennas for wireless router applications.

Accordingly, the present invention, in one aspect, is a tri-band omnidirectional dual-polarized antenna that includes a dielectric resonator, a first substrate containing a first feeding circuit; and a second substrate containing a second feeding circuit. The first substrate and the second substrate are both planar, which form a sandwiching structure with the dielectric resonator. The first and second feeding circuits are adapted to provide dual polarizations to three frequency bands.

In some embodiments, the first substrate is adapted to excite vertically polarized modes of the dielectric resonator in the three frequency bands. The second substrate is adapted to excite horizontally polarized modes of the dielectric resonator in the three frequency bands.

In some embodiments, the first feeding circuit contains a plurality of stubs connected to a circular patch.

In some embodiments, the plurality of stubs is evenly distributed around the circular patch.

In some embodiments, an inclined open stub pair is connected to each of the plurality of stubs.

In some embodiments, the second feeding circuit contains a first loop connected with a plurality of radial strips.

In some embodiments, a free end of each of the plurality of radial strips is extended along a circumferential direction, so that a second loop separated from the first loop is defined.

In some embodiments, an open stub is connected to each of the plurality of radial strips.

In some embodiments, to each of the plurality of radial strips there is connected an arc strip.

In some embodiments, each arc strip contains a folded section to adjust frequency ratios of the three frequency bands.

In some embodiments, the first substrate is sandwiched between the dielectric resonator and the second substrate. The dual-polarized antenna further includes feeding cables connected to a bottom side of the second substrate for feeding circuits on the first substrate and the second substrate.

In some embodiments, the dielectric resonator is made of glass.

One can see embodiments of the invention therefore provide compact tri-band dual-polarized omnidirectional antennas for Wi-Fi router applications. Such an omnidirectional antenna covers three Wi-Fi bands (2.4, 5.2, and 5.8 GHz) by using only one antenna. Therefore, there is no need to deploy multiple antennas as in conventional art to enable tri-band communications. Also, the antennas in embodiments of the invention have a compact size and an aesthetic, and they are easy to assemble.

In practical applications, antennas in embodiments of the invention can be used in the tri-band wireless communication systems to provide large signal coverage and stable wireless access for mobile terminals. Due to its polarization diversity and tri-band operation, the antennas can be used to replace two/four current commercial Wi-Fi antennas.

The foregoing summary is neither intended to define the invention of the application, which is measured by the claims, nor is it intended to be limiting as to the scope of the invention in any way.

BRIEF DESCRIPTION OF FIGURES

The foregoing and further features of the present invention will be apparent from the following description of embodiments which are provided by way of example only in connection with the accompanying figures, of which:

FIG. 3*a* is a top view of the lower substrate of the antenna of FIG. 1.

In the drawings, like numerals indicate like parts throughout the several embodiments described herein.

DETAILED DESCRIPTION

Figure 1:
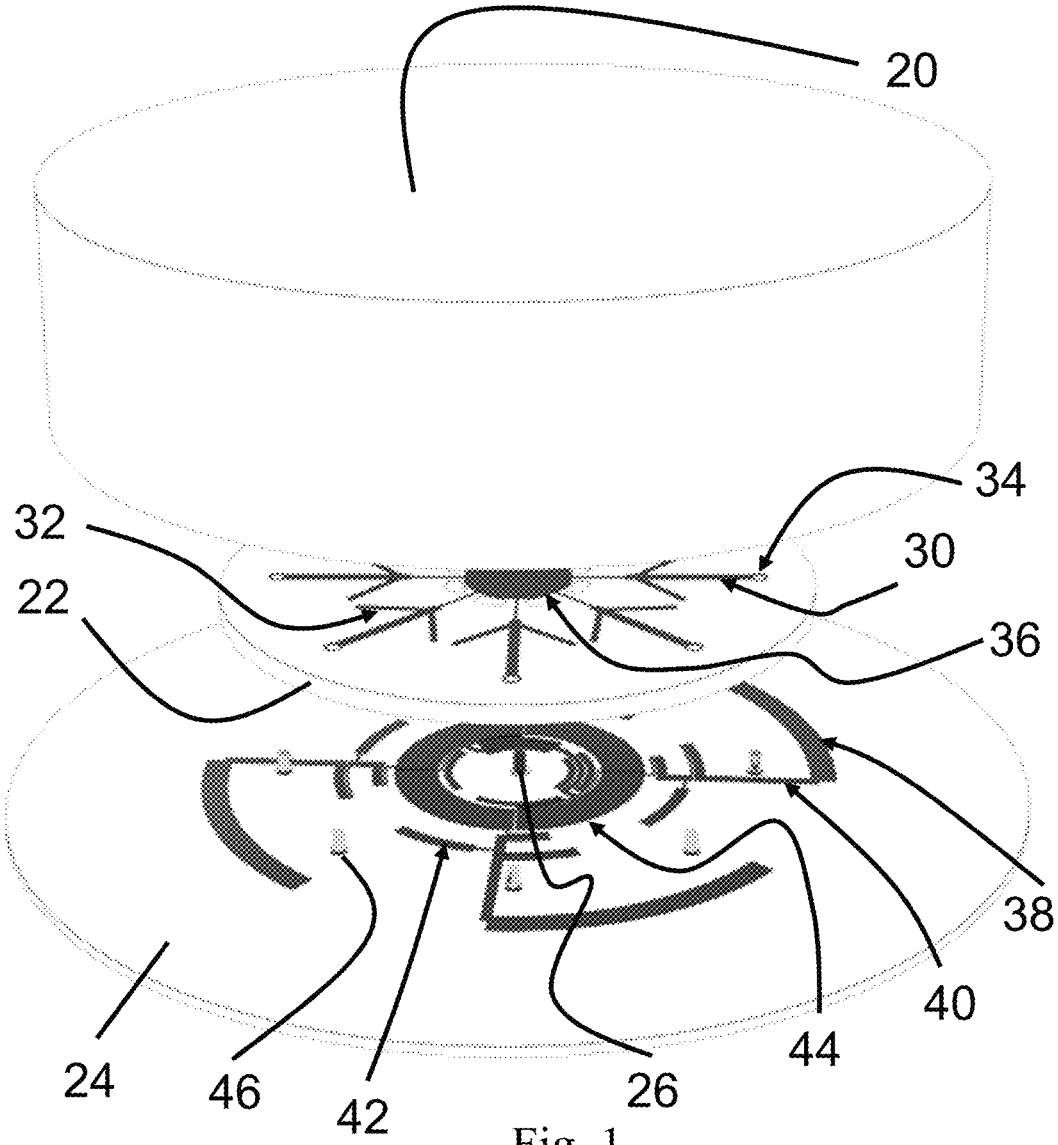
FIG. 1 is a perspective and exploded view of a dual-polarized omnidirectional antenna according to a first embodiment of the invention.
Figure 2:
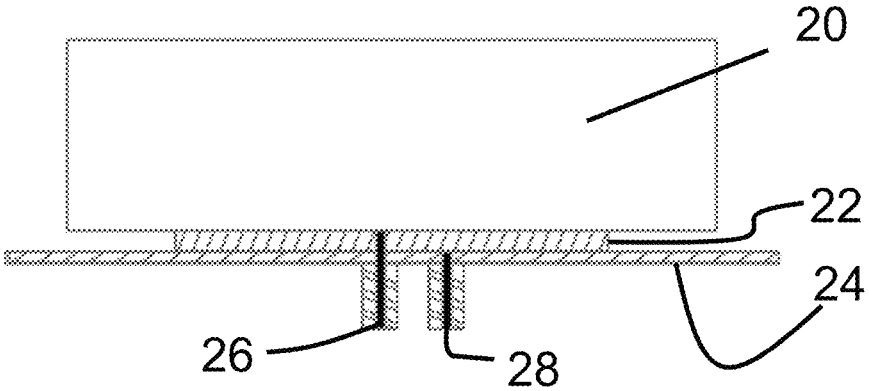
FIG. 2 is a cross-sectional side view of the antenna of FIG. 1 in its assembled form.

Referring now to FIGS. 1-2, in which the structure of a compact low-profile tri-band dual-polarized omnidirectional antenna according to a first embodiment of the invention is shown. The antenna contains three parts, namely a dielectric resonator 20, a first substrate 22, and a second substrate 24, the three forming a sandwich structure. Both the first substrate 22 and the second substrate 24 are planar and they are stacked one above another. In particular, the first substrate 22 is located above the second substrate 24 and underneath the dielectric resonator 20, as shown in FIGS. 1-2. Each of the first substrate 22 and the second substrate 24 carries one or more feeding circuits for the dielectric resonator 20, as will be described in more details later. In this way, the first substrate 22 and the second substrate 24 are effectively printed circuit boards (PCB). At the bottom side of the second substrate 24, there are connected two feeding cables including a first feeding cable 26 electrically connected to the first substrate 22, and a second feeding cable 28 electrically connected to the second substrate 24.

The dielectric resonator 20 is made from a dielectric material, and a preferable material is glass for a pleasant look of the antenna. The dielectric resonator 20 as shown in FIGS. 1-2 has a cylindrical shape, and has a diameter smaller than that of the second substrate 24 whilst larger than that of the first substrate 22. The dielectric resonator 20 also has a thickness more than a combined thickness of the first substrate 22 and the second substrate 24.

Figure 3A:
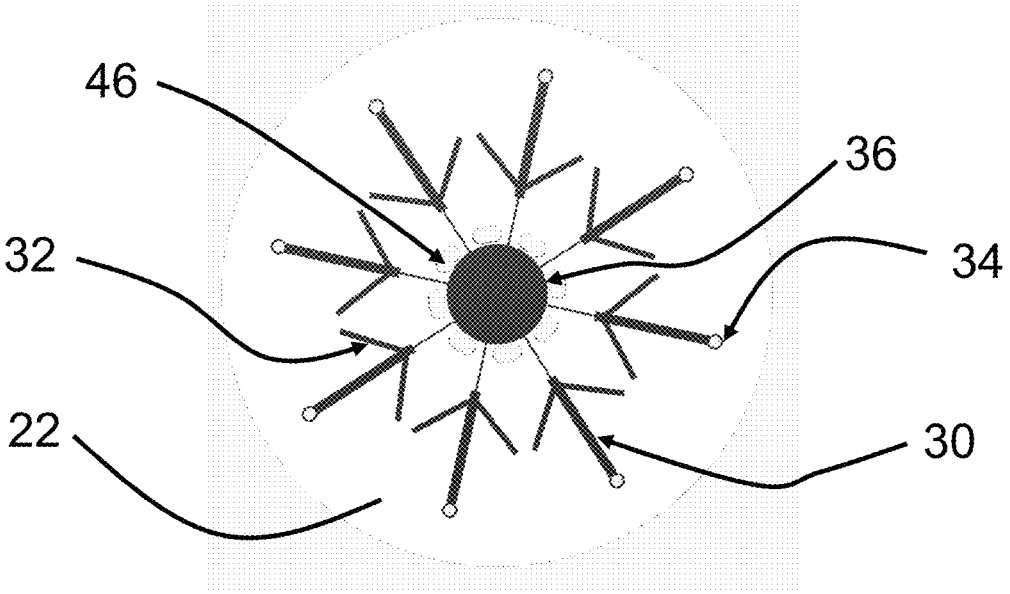
FIG. 3*a* is a top view of the upper substrate of the antenna of FIG. 1.
Figure 3B:
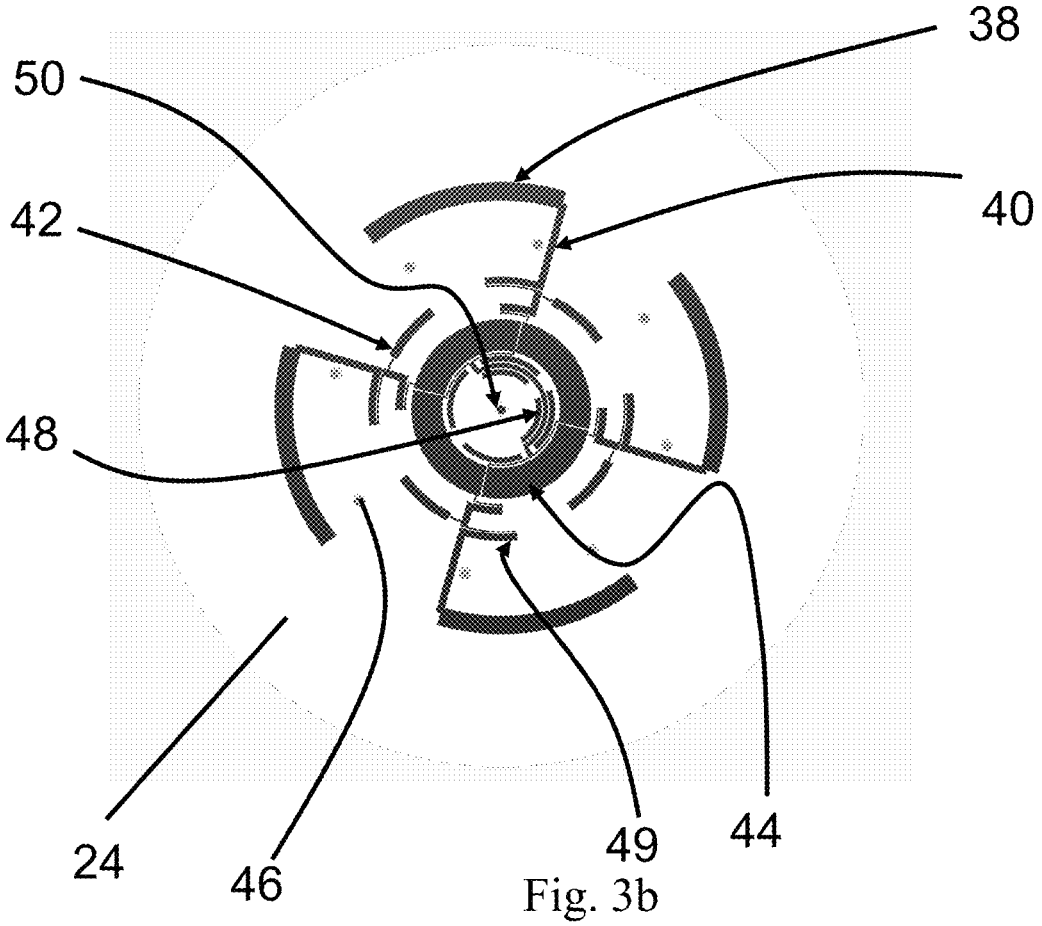

As shown in FIGS. 1 and 3*a*, on the top surface of the first substrate 22, there is a first feeding circuit for a first band, which containing a circular patch 36 at the center of the first substrate 22 which is electrically connected at a bottom side thereof to the first feeding cable 26. As best seen in FIGS. 2 and 3*b*, the first feeding cable 26 passes through a central hole 50 located at the second substrate 24, and there is no electrical connection between the first feeding cable 26 and the second substrate 24. Back to FIG. 3*a*, there are a plurality of shorted stubs 30 connected to and extend from the circular patch 36 along radially outward directions. All the shorted stubs 30 are evenly distributed around the circular patch 36 so the span between every two adjacent shorted stubs 30 is 45°. The shorted stubs 30 are shorted to the bottom of the second substrate 24, which is a metallic layer and recognized as the ground plane. Between every two adjacent shorted stubs 30, there is formed an ecliptic through hole 46 on the first substrate 22. The through holes 46 are used to mitigate the effect of the shorted stubs 30 between meander lines 48 on the cross-polarization level. In this example, there are eight shorted stubs 30 connected to the circular patch 36, which is used to excite vertically polarized (VP) modes of the dielectric resonator in the lower band (e.g., a first band at ~2.4 GHz) and thus radiate vertically polarized electromagnetic waves. In addition, an inclined open stub pair 32 is connected to each of the shorted stubs 30, which helps generate modes in the upper bands (e.g., a second band at ~5.2 GHz and a third band at ~5.8 GHz). Therefore, vertical polarization can be obtained in both the lower and the upper Wi-Fi bands (three frequency bands in total). One can see that within each inclined open stub pair 32 the two open stubs have the same length, and each inclined open stub pair 32 together with its corresponding shorted stub 30 form an arrow shape that points toward to the circular path 36. At the free end of each of the shorted stubs 30 there is formed a shorted via 34 which adjust the operating frequency of the shorted stubs 30, and also for stacking the first substrate 22 on the second substrate 24.

Turning to FIG. 3*b*, on a top surface of the second substrate 24 there is carried a second feeding circuit for exciting horizontally polarized modes of the dielectric resonator 20 in the three frequency bands. In particular, a 1-4 power divider is connected to a central loop 44 and the power divider consists of a plurality of arc strips 49 and open stubs 42 to excite horizontally polarized modes of the dielectric resonator 20 in the upper bands. Each arc strip 49 contains extended and folded parts that extend along a circumferential direction (a counterclockwise direction as shown in FIG. 3*b*), and is connected to a respective radial strip 40. A free end of each radial strip 40 extends along a circumferential direction (a counterclockwise direction as shown in FIG. 3*b*) to form a curved strip 38. As FIG. 3*b* shows four radial strips 40 connected to and extending from the central loop 44, there are also four curved strips 38 in total. All the curved strips 38 are located on a same hypothetical circle (not shown) that is concentric with the central loop 44. Therefore, the four curved strips 38 together define a loop shape that is concentric with the central loop 44 but larger than the central loop 44. The four curved strips 38 are adapted to excite the modes of the dielectric resonator 20 in the lower band (first band). The loop shape defined by the four curved strips 38 is not continuous because the four curved strips 38 are separated from each other by gaps. Between the curved strip 38 and the central loop 44, on each of the radial strips 40 there is connected the open stub 42 to suppress higher-order modes of the loop shape formed by the curved strips 38 in the upper bands, which avoids the distortion of the radiation patterns. All the open stubs 42 are located on a same hypothetical circle (not shown) that is concentric with the central loop 44, and are extend along a circumferential direction (along a clockwise direction). Simultaneously, the open stubs 42 help adjust the horizontally-polarized higher-order mode of the dielectric resonator 20 in the third band (e.g., 5.8 GHz). Also, each arc strip 49 has folded parts and extended parts to adjust the frequency ratios of the three bands, which are conducive to adapting to the application requirements. On the other hand, FIG. 3*b* shows meander lines 48 within the central loop 44, and the meander lines 48 are used to reduce the radiation of the feeding circuit between the meander lines 48. Also, in the second substrate 24 there are a plurality of studs 46 (best seen in FIG. 1) configured which point upward. These studs 46 are received in the shorted vias 34 of the first substrate 22 when the antenna is assembled so as to fix the first substrate 22 and the second substrate 24 together.

Figure 4:
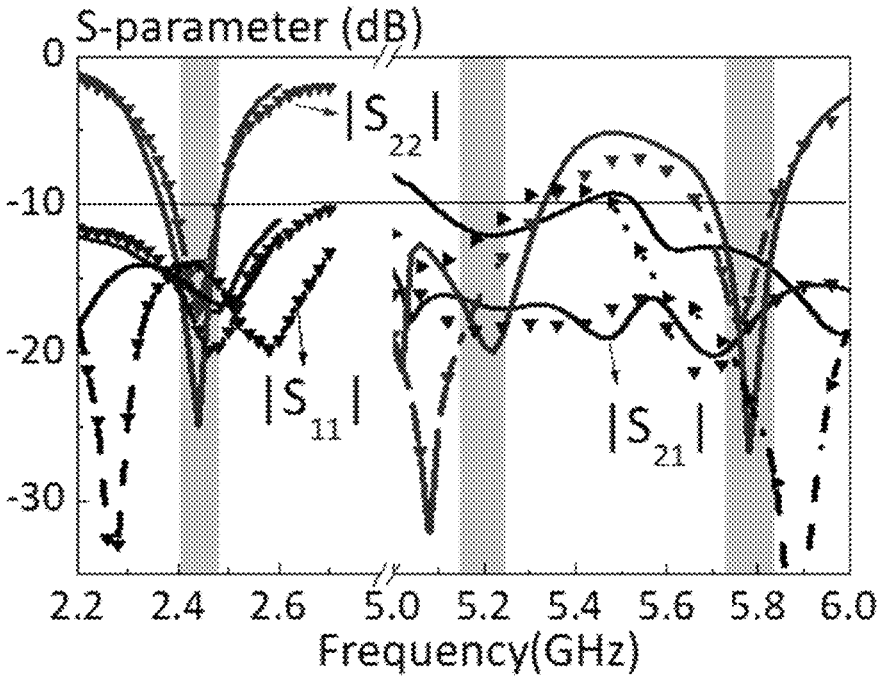
FIG. 4 shows the simulated and measured (on a prototype) S-parameters of the antenna of FIG. 1.

Having described the structure of the antenna with references to FIGS. 1-3*b*, in the following section performance of the antenna both as simulated and as measured (on a prototype) are discussed. In the prototype and the simulated model, the dielectric resonator 20 has a diameter of 69.5 mm, and a height of 18 mm. FIG. 4 shows the simulated and measured S-parameters of the antenna. It can be found that reasonable agreement is obtained between the simulated and measured results. With reference to FIG. 4, the measured −10 dB impedance passbands for vertically polarized (VP) port (i.e., via the first feeding cable 26) are 2.2-2.7 GHz, 5-5.29 GHz, and 5.48-6 GHz. As for the horizontally polarized (HP) port (i.e., via the second feeding cable 28), the measured passbands are 2.38-2.485 GHz, 5-5.33 GHz and 5.66-5.85 GHz. As a result, the overlapped bands in the HP modes and the VP modes are 2.38-2.485 GHz, 5-5.29 GHz, and 5.66-5.85 GHz, fully covering the three Wi-Fi bands under Wi-Fi 6. Also, the port isolations are as high as 15 dB, 18 dB, and 17 dB for the three frequency bands respectively. Higher isolation can be obtained by using a thinner PCB for the first substrate 22 and/or the second substrate 24.

Figure 5A:
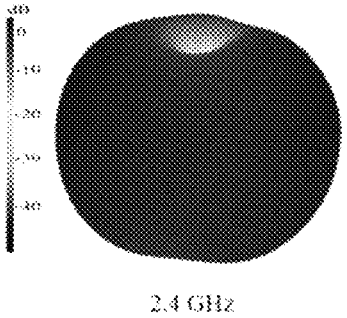
FIG. 5*a* illustrates the simulated and measured (on a prototype) 2.44 GHz radiation pattern of the vertically polarized port of the antenna of FIG. 1.
Figure 5B:
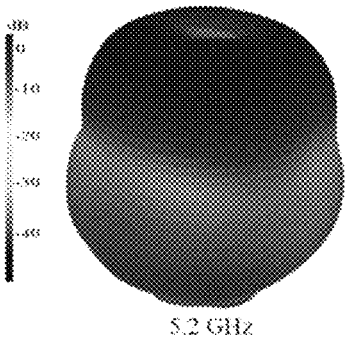
FIG. 5*b* illustrates the simulated and measured (on a prototype) 5.2 GHz radiation pattern of the vertically polarized port of the antenna of FIG. 1.
Figure 5C:
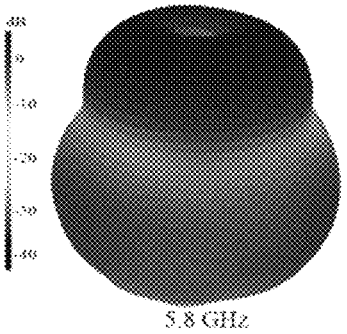
FIG. 5*c* illustrates the simulated and measured (on a prototype) 5.8 GHz radiation pattern of the vertically polarized port of the antenna of FIG. 1.
Figure 6A:
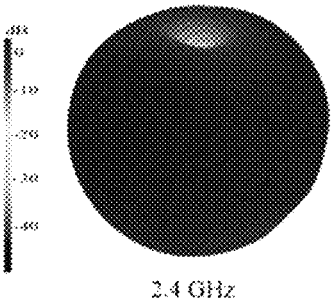
FIG. 6*a* illustrates the simulated and measured (on a prototype) 2.44 GHz radiation pattern of the horizontally polarized port of the antenna of FIG. 1.
Figure 6B:
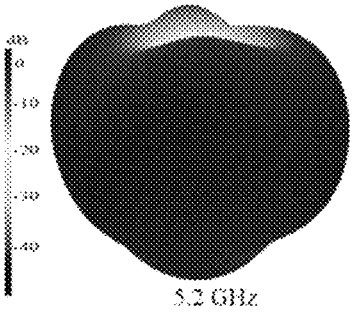
FIG. 6*b* illustrates the simulated and measured (on a prototype) 5.2 GHz radiation pattern of the horizontally polarized port of the antenna of FIG. 1.
Figure 6C:
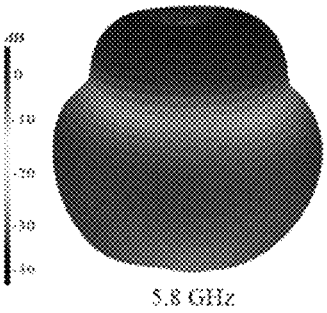
FIG. 6*c* illustrates the simulated and measured (on a prototype) 5.8 GHz radiation pattern of the horizontally polarized port of the antenna of FIG. 1.

FIGS. 5*a*-5*c* show the simulated and measured normalized radiation patterns at 2.44, 5.2, and 5.8 GHz from the VP port, and FIGS. 6*a*-6*c* show the simulated and measured normalized radiation patterns at 2.44, 5.2, and 5.8 GHz from the HP port. As can be seen from FIGS. 5*a*-6*c*, omnidirectional radiation fields are obtained in the horizontal plane. The peak antenna gains are between 1-6 dBi.

The exemplary embodiments are thus fully described. Although the description referred to particular embodiments, it will be clear to one skilled in the art that the invention may be practiced with variation of these specific details. Hence this invention should not be construed as limited to the embodiments set forth herein.

While the embodiments have been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

What is claimed is:

1. A tri-band omnidirectional dual-polarized antenna, comprising:

a) a dielectric resonator;

b) a first substrate comprising a first feeding circuit; and c) a second substrate comprising a second feeding circuit;

wherein the first feeding circuit and the second feeding circuit are both planar, which form a sandwiching structure with the dielectric resonator; the first and second feeding circuits adapted to provide respectively a vertical polarization and a horizontal polarization to three frequency bands;

wherein the first substrate is adapted to excite vertically polarized modes of the dielectric resonator in the three frequency bands; the second substrate is adapted to excite horizontally polarized modes of the dielectric resonator in the three frequency bands.

2. The dual-polarized antenna according to claim 1, wherein the first feeding circuit comprises a plurality of terminally shorted stubs connected to a circular patch.

3. The dual-polarized antenna according to claim 2, wherein the plurality of terminally shorted stubs is evenly distributed around the circular patch.

4. The dual-polarized antenna according to claim 2, wherein an inclined open stub pair is connected to each of the plurality of terminally shorted stubs.

5. The dual-polarized antenna according to claim 2, wherein the second feeding circuit comprises a first loop connected with a plurality of radial strips.

6. The dual-polarized antenna according to claim 5, wherein a free end of each of the plurality of radial strips is extended along a circumferential direction, so that a second loop separated from the first loop is defined.

7. The dual-polarized antenna according to claim 5, wherein an open stub is connected to each of the plurality of radial strips.

8. The dual-polarized antenna according to claim 5, wherein to each of the plurality of radial strips there is connected an arc strip.

9. The dual-polarized antenna according to claim 8, wherein each said arc strip comprises extended and folded parts to adjust frequency ratios of the three frequency bands.

10. The dual-polarized antenna according to claim 1, wherein the first substrate is sandwiched between the dielectric resonator and the second substrate; the dual-polarized antenna further comprising feeding cables connected to a bottom side of the second substrate for feeding circuits on the first substrate and the second substrate.

11. The dual-polarized antenna according to claim 1, wherein the dielectric resonator is made of glass.

12. The dual-polarized antenna according to claim 5, wherein the second feeding circuit further comprises meander lines configured with the first loop.

13. The dual-polarized antenna according to claim 1, wherein a ratio between a highest frequency and a lowest frequency among the three frequency bands is greater than 2.

* * * * *